United States Patent [19]

Dahl

[11] 4,061,382

[45] Dec. 6, 1977

[54] DOOR LOCKING MECHANISM FOR COKE OVEN DOOR

[75] Inventor: Klaus-Peter Dahl, Gelsenkirchen, Germany

[73] Assignee: Didier Engineering GmbH, Essen, Germany

[21] Appl. No.: 753,090

[22] Filed: Dec. 21, 1976

[30] Foreign Application Priority Data

Dec. 31, 1975 Germany ..... 2559311

[51] Int. Cl.[2] ..... E05C 19/00

[52] U.S. Cl. ..... 292/260; 292/251

[58] Field of Search ..... 292/67, 69, 251, 259, 292/260

[56] References Cited

U.S. PATENT DOCUMENTS

| | | | |
|---|---|---|---|
| 1,138,179 | 5/1915 | Boyles | 292/256.73 X |
| 2,172,943 | 9/1939 | Norris | 292/256.73 X |
| 2,798,752 | 7/1957 | Doll | 292/260 |

*Primary Examiner*—Richard E. Moore

*Attorney, Agent, or Firm*—Wenderoth, Lind & Ponack

[57] ABSTRACT

A bolt has an inner end threaded into a door body. A sleeve surrounds the bolt, and a locking bar surrounds the sleeve. A spring is supported by the bolt and urges the sleeve and locking bar toward the outer end of the bolt. A nut is threaded onto the outer end of the bolt and contacts the sleeve, so that rotation of the nut moves the sleeve axially of the bolt to adjust the pressure of the spring on the locking bar. A lock nut is screwed onto the outer end of the bolt and is locked to the nut, so that rotation of the lock nut rotates the bolt and adjusts the circumferential position of the locking bar.

8 Claims, 1 Drawing Figure

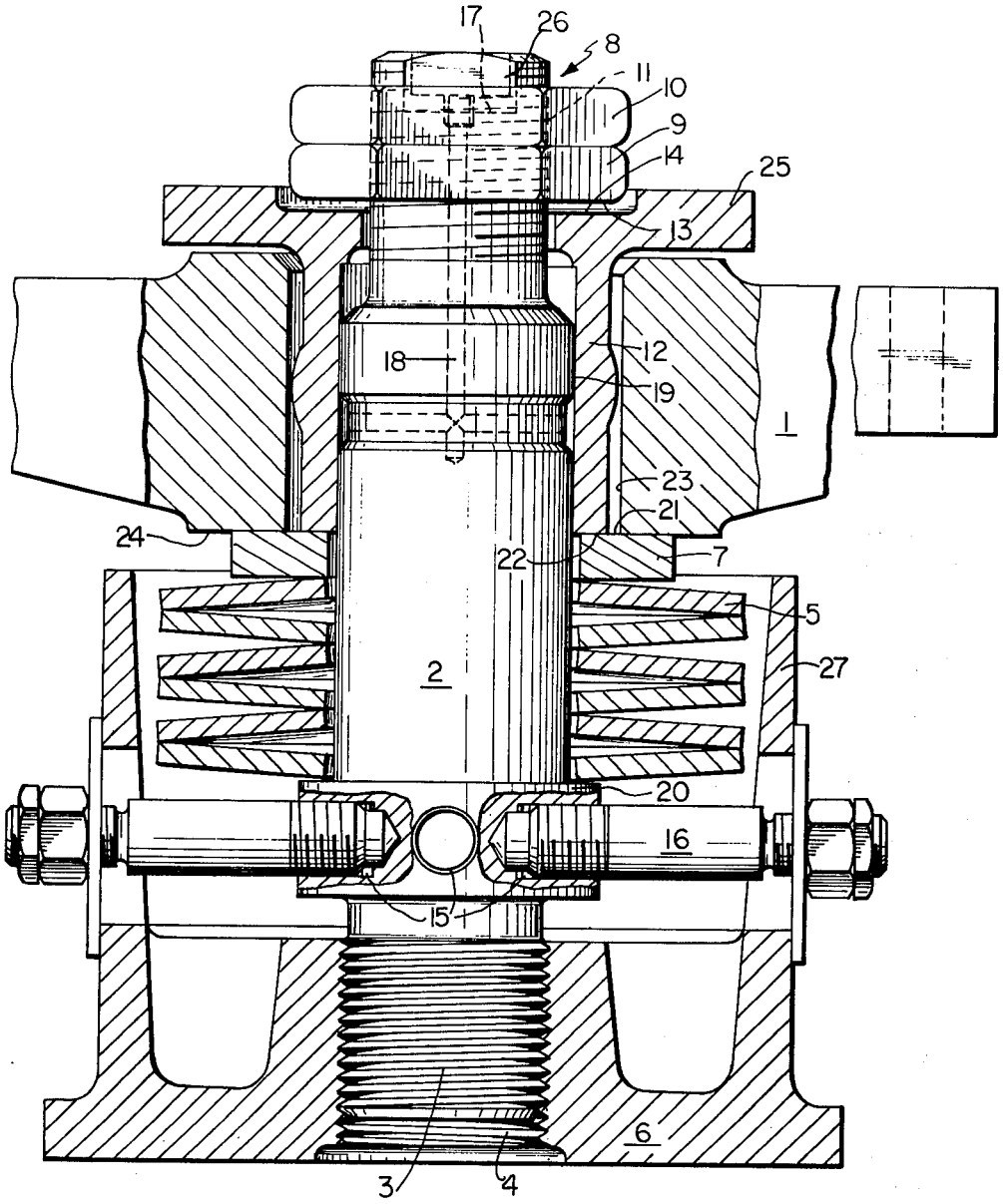
17
26
8
11
10
9
14
25
13
18
12
19
1
23
21
24
22
7
5
2
27
20
16
15
6
3
4

DOOR LOCKING MECHANISM FOR COKE OVEN DOOR

BACKGROUND OF THE INVENTION

The present invention relates to a door locking mechanism for locking and unlocking coke oven doors of the type wherein in the locking position the door body is held in contact with a door frame by spring pressure and by a locking bar which extends behind attachments or hooks of the door frame, the locking bar being pivoted into the locking position about a bolt which is screwed into an opening of the door body, wherein a sleeve element surrounding the bolt is inwardly axially displaceable for the purpose of releasing the locking bar from the locking position, wherein during its axial inward displacement, the sleeve element releases the spring pressure between the locking bar and the door frame, and wherein the spring pressure and the position of the locking bar with respect to the locking bar hooks can be adjusted.

A door locking mechanism of this type is shown by Grossinsky: Handbuch des Kokereiwesens [Manual of Coking Practice], 1955 Volume I, page 238, FIG. 117. The bolt of this known door locking mechanism has at the front end thereof a collar which is contacted by the outer surface of the sleeve element. The bolt is threaded by means of which the bolt can be axially displaced by rotating the bolt within a further sleeve element which surrounds the bolt. Such further sleeve element has an external thread by means of which it is possible to axially adjust the further sleeve element and, therewith, also the entire spring arrangement and the position of the locking bar with respect to the attachments or hooks of the door frame. The spring pressure is provided by a cup spring which is positioned between a shoulder of the further sleeve element and a pressure plate, which contacts the inner surface of the first sleeve element and the locking bar. The spring pressure is applied by rotating the bolt with respect to the further sleeve element, thereby determining the axial position of the first sleeve element. The relative position of the locking bar with respect to the locking bar hooks is adjusted by rotating the further sleeve element in the threaded opening of the door body. However, the further sleeve element is accessible to rotation only when the bolt is completely unscrewed and when the first sleeve element is removed.

SUMMARY OF THE INVENTION

Accordingly, the object of the invention is to provide a structurally simpler door locking mechanism of the type mentioned above, wherein both the adjustment of the spring pressure and also the adjustment of the relative position of the locking bar with respect to the attachments or hooks of the door frame can be readily effected from the exterior of the device.

This object is achieved according to the present invention in that the spring pressure can be adjusted by means of a new screwed onto the head or outer end of the bolt. This nut has an inner surface which contacts the outer surface of the sleeve element. The position of the locking bar with respect to the attachments or hooks of the door frame can be adjusted by rotating the bolt which is threaded into an opening of the door body. Such rotation of the bolt axially displaces the bolt relative to the door body.

Accordingly, while in accordance with the prior art device the spring pressure is adjusted by turning the bolt, and the position of the locking bar with respect to the hooks is changed by means of a relatively inaccessible further sleeve element, the present invention provides for adjustment of the spring pressure by means of a nut screwed onto the head of the bolt, and the position of the locking bar with respect to the locking bar hooks is adjusted by turning the bolt in a threaded opening of the door body. Both such adjustments can thus be readily achieved from the exterior of the device by simple manipulations on the head of the bolt.

German Pat. No. 824,633 discloses changing the position of the locking bar with respect to the locking bar hooks by turning the bolt in a threaded opening of the door body. However, such adjustment is known only in a door locking mechanism which does not include a sleeve element the axial displacement of which is used to remove pressure from the locking bar. Rather, in this known arrangement the pressure is released only by turning the bolt in the threaded opening of the door bolt. The bolt has, for this purpose, a separate flange which contacts a pressure plate that is arranged on cup springs. Therefore, the pressure relief procedure of this known device is substantially more complex than that of the door locking mechanism of the invention.

In accordance with a further feature of the door locking mechanism of the invention, a lock nut is screwed onto the head of the bolt outwardly of the first nut to lock the first nut. In this manner it is possible to precisely adjust the position of the locking bar with respect to the attachments or hooks of the door frame by turning the lock nut, which is fixed to the first nut, and thereby turn the entire bolt in the threaded opening of the door body. Additionally or alternatively, the head of the bolt may be provided with a flat engagement surface to allow turning of the entire bolt.

The bolt is preferably locked with respect to the door body, so as to prevent any accidental change in the position of the locking bar with respect to the attachments or hooks of the door frame. This may be achieved in accordance with the invention by providing the bolt with transverse threaded bores, into which are screwed threaded bolts which are fixed with respect to the door body.

With the door locking mechanism in accordance with the invention, when the inner surface of the sleeve element slides on the outer circumferential surface of the bolt, it is important that such sliding surfaces be effectively lubricated. According to the present invention, such lubrication is achieved in a simple manner by arranging a lubricant duct extending from an outer surface of the bolt, through the bolt to the sliding surfaces between the sleeve element and the bolt.

BRIEF DESCRIPTION OF THE DRAWING

Further objects, features and advantages of the present invention will be apparent from the following detailed description of an exemplified embodiment thereof, with reference to the attached drawing, wherein:

The single FIGURE is a schematic view, partially in section, of one specfic embodiment of the door locking mechanism of the present invention.

DETAILED DESCRIPTION OF THE INVENTION

A door body 6, a portion only of which is shown, has extending therethrough a threaded opening 4. A bolt 2 has a threaded inner end 3 which is threaded into opening 4. Bolt 2 has, outwardly of end 3, an annular shoulder 20 which supports an inner end of cup springs 5 which surround bolt 2. A pressure plate 7 also surrounds bolt 2, is in the form of a ring disk, and has an inner surface contacting the outer surface of cup springs 5. An outer surface 21 of pressure plate 7 is contacted both by an inner surface 22 of a sleeve element 12 slidingly mounted about bolt 2 and also by an inner surface 24 of a locking bar 1 which is provided with a central opening 23 which receives sleeve element 12.

In the door locking position, locking bar 1 has arms (not shown) which extend behind and engage locking bar hooks or attachments of the door frame. Such door frame and hooks are conventional and thus are not shown. Locking bar 1 pivots about sleeve element 12 which surrounds bolt 2. Sleeve element 12 extends outwardly beyond locking bar 1 and thereat has a radially outwardly extending flange 25 which can be acted upon by means of an unlocking device for the purpose of displacing sleeve element 12 axially inwardly on bolt 2. Such axial inward displacement of sleeve element 12 moves pressure plate 7 inwardly and thereby compresses cup springs 5. This releases the pressure of cup springs 5 from locking bar 1, so that it can be pivoted about sleeve element 12 such that the arms of bar 1 are removed from the locking bar hooks, and thereby the door is unlocked.

Bolt 2 has at the outer end thereof a head 8 including a threaded outer end 11 of bolt 2, an inner nut 9 screwed onto thread 11, and a counter or lock nut 10 screwed onto thread 11 outwardly of nut 9. Nut 9 has an inner surface 13 contacting an outer surface 14 of sleeve element 12. Rotation of nut 9 on bolt 2 thus provides for adjustment of the spring pressure of cup springs 5, through sleeve element 12 and pressure plate 7. Further, if necessary, continued rotation of nut 9 inwardly of bolt 2 may be employed to release the spring pressure acting on locking bar 1. Rotation of lock nut 10 which is locked against nut 9 turns bolt 2 in threaded opening 4. Thereby, it is possible to axially shift bolt 2 with respect to door 6. This rotation of bolt 2 will also allow adjustment of the circumferential position of locking bar 1 with respect to the locking bar hooks. Additionally, however, the outer end of bolt 2 may have a flat edge 26 by means of which it is likewise possible to rotate bolt 2 to move bolt 2 axially and to adjust the position of locking bar 1.

In order to secure locking bar 1 in its relative position to the locking bar hooks and to avoid the possibility of an accidental displacement from such position, bolt 2 may be circumferentially or rotatively fixed relative to door 6. For example, bolt 2 may have therein a suitable number, e.g. four, of preferably radial threaded bores 15, preferably equally spaced about the circumference of bolt 2. Threaded bolts 16 can be screwed into bores 15, and bolts 16 extend through and are fixed against lateral displacement by an outwardly projecting flange of collar 27 of door body 6. Further, collar 27 may extend outwardly by a distance to completely cover and surround cup springs 5, thereby protecting the cup springs.

A lubricant supply duct 18 leads from an outer surface 17 of bolt 2 to sliding contact surfaces 19 between bolt 2 and sleeve element 12. Sliding contact surfaces 19 can thus be lubricated in a simple manner from the exterior of the device.

Various modifications may be made to the above specifically described structural arrangements without departing from the scope of the invention.

What is claimed is:

1. A door locking mechanism for locking doors, particularly coke oven doors of the type wherein when in the locked position the door is pressed against a door frame by spring pressure and held in such position by a locking bar engaged against hooks on the door frame, said mechanism comprising:

an integral and single-piece bolt having an inner end adapted to be threaded into a door body of a door to be locked and an outer end;

a sleeve element axially slidably mounted about said bolt;

a locking bar rotatably mounted about said sleeve element with said outer end of said bolt extending outwardly beyond said locking bar, said locking bar having arms adapted to be engaged behind hooks of a door frame of the door to be locked to lock the door;

spring means supported by said bolt and urging said sleeve element and said locking bar outwardly of said bolt toward said outer end thereof;

said sleeve element being movable axially of said bolt toward said inner end thereof to compress said spring means and to thus release the pressure of said spring means from said locking bar, such that said locking bar can be rotated;

means, threaded onto said outer end of said bolt at a position outwardly of said locking bar and contacting said sleeve element, for selectively axially displacing said sleeve element with respect to said bolt and for thereby adjusting the spring pressure of said spring means applied to said locking bar; and means, at said outer end of said bolt and positioned outwardly of said locking bar, for selectively rotating and axially displacing said bolt with respect to the door and thereby adjusting the circumferential position of said locking bar with respect to the hooks of the door frame, said bolt rotating means being freely accessible from the exterior without removal of said sleeve element displacing means.

2. A mechanism as claimed in claim 1, wherein said sleeve element displacing means comprises a nut screwed onto said outer end of said bolt.

3. A mechanism as claimed in claim 2, wherein said bolt rotating means comprises a lock nut screwed onto said outer end of said bolt and locked against said nut.

4. A mechanism as claimed in claim 1, wherein said bolt rotating means comprises at least one flattened surface on said outer end of said bolt.

5. A mechanism as claimed in claim 1, further comprising means for preventing rotation of said bolt with respect to the door body of a door to be locked.

6. A mechanism as claimed in claim 5, wherein said rotation preventing means comprises at least one threaded bore extending transversely into said bolt, and screw means threaded into said bore and adapted to be fixed with respect to the door body of a door to be locked.

7. A mechanism as claimed in claim 1, wherein said bolt and said sleeve element have respective outer and inner surfaces in frictional sliding contact, and further comprising means for lubricating said surfaces from a position at said outer end of said bolt.

8. A mechanism as claimed in claim 7, wherein said lubricating means comprises a lubricant duct extending from an outer end surface of said bolt, through said bolt to said surfaces in frictional sliding contact.

* * * * *